US010398201B2

(12) United States Patent
Ogata

(10) Patent No.: US 10,398,201 B2
(45) Date of Patent: Sep. 3, 2019

(54) COLLET AND JEWELRY

(71) Applicant: SHOKOSHA CO., LTD., Tokyo (JP)

(72) Inventor: Shiro Ogata, Tokyo (JP)

(73) Assignee: SHOKOSHA CO., LTD., Tokyo (JP)

( * ) Notice: Subject to any disclaimer, the term of this patent is extended or adjusted under 35 U.S.C. 154(b) by 72 days.

(21) Appl. No.: 15/600,924

(22) Filed: May 22, 2017

(65) Prior Publication Data

US 2018/0332932 A1 Nov. 22, 2018

(51) Int. Cl.
*A44C 17/02* (2006.01)
*A44C 13/00* (2006.01)

(52) U.S. Cl.
CPC ..... *A44C 17/02* (2013.01); *A44C 13/00* (2013.01)

(58) Field of Classification Search
CPC ..... A44C 17/02; A44C 13/00
USPC ..... 63/26–27
See application file for complete search history.

(56) References Cited

U.S. PATENT DOCUMENTS 1,453,708 A 5/1923 Gaschke
4,793,156 A 12/1988 Pence
6,023,947 A * 2/2000 Afuku ..... A44C 3/008 63/26

FOREIGN PATENT DOCUMENTS

JP H07-55959 A 3/1995
JP H11-305671 A 11/1999
JP 2003-299513 A 10/2003
JP 2011-120779 A 6/2011

OTHER PUBLICATIONS

Aug. 29, 2017 Japanese Office Action issued in Japanese Patent Application No. JP 2015-229906.

* cited by examiner

*Primary Examiner* — Abigail E Troy
(74) *Attorney, Agent, or Firm* — Oliff PLC

(57) ABSTRACT

A collet capable of increasing a degree of exposure of an ornament and providing high productivity is provided. The collet includes two plate members 3 and 5 that hold an ornament 7. The respective plate members 3 and 5 include support portions 9 and 23 that each include a region with which a back surface side of the ornament 7 is in contact. The respective plate members 3 and 5 include pairs of claw portions 11*a* and 11*b*, and 25*a* and 25*b* which extend from distal ends of the support portions 9 and 23, and are formed to be able to be locked on the front surface side of the ornament 7. Furthermore, the respective plate members 3 and 5 include notched portions 21 and 37 where the support portions 9 and 23 are caused to cross each other and engage with each other.

4 Claims, 6 Drawing Sheets

COLLET AND JEWELRY

BACKGROUND OF THE INVENTION

Field of the Invention

The present invention relates to a collet that holds an ornament and jewelry provided with this collet.

Description of the Related Art

Conventionally, various kinds of jewelry such as bracelets, necklaces, pendants and rings are known as jewelry using ornaments such as jewels and precious metals. For example, for a bracelet using jewels, the jewels are held to collets connected to a chain or the like. As such a kind of collet, a collet is known which has a structure including a support portion that supports a jewel and a plurality of claw portions that stand from the support portion, in which a back surface side of the jewel is brought into contact with the support portion and the plurality of claw portions lock the jewel by surrounding a front surface side of the jewel. Such a collet allows a cut surface of the jewel to be exposed from between neighboring claw portions, and the higher the degree of exposure, the greater is the brilliance of the jewel that can be extracted.

Such a kind of collet is manufactured using various manufacturing methods. JP7-55959A describes a method whereby a work piece is cut through a cutting process and a collet of a desired shape is integrally manufactured. Furthermore, according to JP2003-299513A, a pedestal that supports an ornament and a lower frame that extends from the pedestal are integrally formed through press molding. JP2003-299513A describes a method of brazing a separately manufactured upper frame at a top end of the lower frame and manufacturing a collet into a shape surrounding the ornament. JP11-305671A describes a method of integrally manufacturing a collet including a plurality of claw portions through cast molding.

According to the cutting process as described in JP7-55959A, the work piece is cut using a drill or the like to form a desired shape, and so an elongated shape like a claw portion that locks the jewel cannot be cut. For that reason, the claw portion needs to be set to a large size in design in order to manufacture the collet through the cutting process, which results in a problem that the degree of exposure of the ornament decreases.

In contrast, the press molding according to JP-A-2003-299513 makes it possible to form an elongated shape such as a claw portion. However, it is necessary to form a three-dimensional shape such as a collet, that is, a shape having a support portion that supports an ornament and a plurality of claw portions extending from the support portion so as to surround the ornament. For this purpose, a plurality of parts need to be assembled by joining (brazing) them, which raises concern over a reduction of productivity.

On the other hand, the cast molding according to JP11-305671A makes it possible to integrally mold a three-dimensional collet. However, since the material of a cast article has lower hardness than that of a press-molded article, and so the claw portion needs to be set to a large size in design to secure a holding force of the jewel. For that reason, in the cast collet, the degree of exposure of the ornament decreases as in the case of a cut article.

SUMMARY OF THE INVENTION

The present invention has been implemented in view of the above-described problems and it is an object of the present invention to provide a collet capable of increasing a degree of exposure of an ornament and providing high productivity.

In order to solve the above-described problems, a collet according to the present invention is provided with two plate members that hold an ornament, the two plate members each including a support portion that includes a region with which a back surface side of an ornament is in contact, a pair of claw portions that extend from a distal end of the support portion and are formed to be able to be locked to a front surface side of the ornament, and a notched portion that assembles the support portions so as to cross each other.

Accordingly, the two plate members are engaged with each other so that the notched portions cross each other, and the support portions thereby cross each other and are assembled three-dimensionally. In this way, the pair of claw portions formed in the respective plate members are arranged so as to surround the ornament. The two plate members assembled in this way can hold the ornament by causing the back surface side of the ornament to contact the support portion and locking the respective claw portions to the front surface side of the ornament. Here, since the claw portion and the support portion are each formed of a single plate member, the claw portion and the support portion can be integrally molded through press work. Moreover, though not mutually fixed, the two plate members can restrict mutual movement by their respective claw portions locking the ornament. Therefore, the collet of the present invention makes it possible to form jewelry with simple work of only assembling the two press-molded plate members, swaging the distal ends of the respective claw portions and locking them to the ornament, thus providing high productivity. Since the two plate members can be press-molded irrespective of the plate thickness, their thicknesses can be set to small values unless there is any problem in strength, and moreover, the width of the claw portion when the collet is seen from the outside is the same as the thickness of the plate member of each claw portion. Therefore, due to a smaller width of the claw portion, it is possible to secure a large degree of exposure of the ornament and extract brilliance of the jewel of the ornament.

In this case, the support portions of the two plate members are preferably respectively formed into a shape corresponding to a longitudinal cross-sectional shape of the ornament. Accordingly, since the back surface side of the ornament is disposed along the support portion of the plate member, backlash of the ornament can be reduced and the holding force of the ornament becomes stable.

Any one of the two plate members is preferably provided with a hole through which a connection member that connects another collet or other jewelry is connected. This allows the connection member to be directly connected to the collet and thereby simplifies the structure of the jewelry. When the two plate members are assembled, the two plate members can be easily distinguished based on the presence or absence of the hole, and it is thereby possible to avoid mistakes in procedure of causing these plate members to engage with each other and improve assembly workability of the collet.

In order to solve the above-described problems, jewelry of the present invention includes an ornament and a collet to which the ornament is held, in which the collet is formed with the two plate members, the two plate members each include a support portion that includes a region with which a back surface side of the ornament in contact, a pair of claw portions that extend from distal ends of the support portion and are locked to a front surface side of the ornament, and a notched portion that assembles the support portions so as to cross each other.

In this way, it is possible to improve productivity of the collet, and thereby reduce manufacturing cost as the jewelry. Furthermore, since the degree of exposure of the ornament increases, the beauty of the whole jewelry improves.

According to the present invention, it is possible to provide a collet capable of increasing the degree of exposure of an ornament and providing high productivity.

DETAILED DESCRIPTION OF THE PREFERRED EMBODIMENTS

Hereinafter, an embodiment of jewelry including a collet to which the present invention is applied will be described with reference to the accompanying drawings. Note that the present embodiment will describe an example where a diamond is used as an ornament, but various kinds of ornament such as jewel other than diamond, for example, emerald or sapphire or costume jewelry, precious metal can be used for this ornament.

Figure 1:
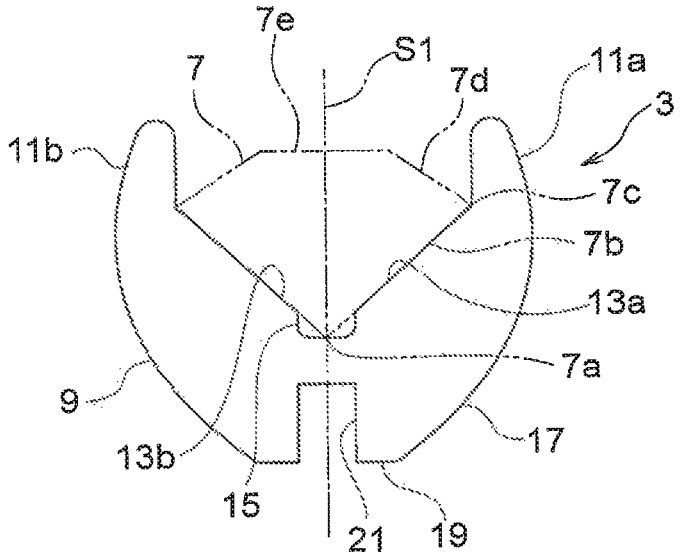
FIG. 1 is a side view illustrating one plate member of a collet to which the present invention is applied.
Figure 2:
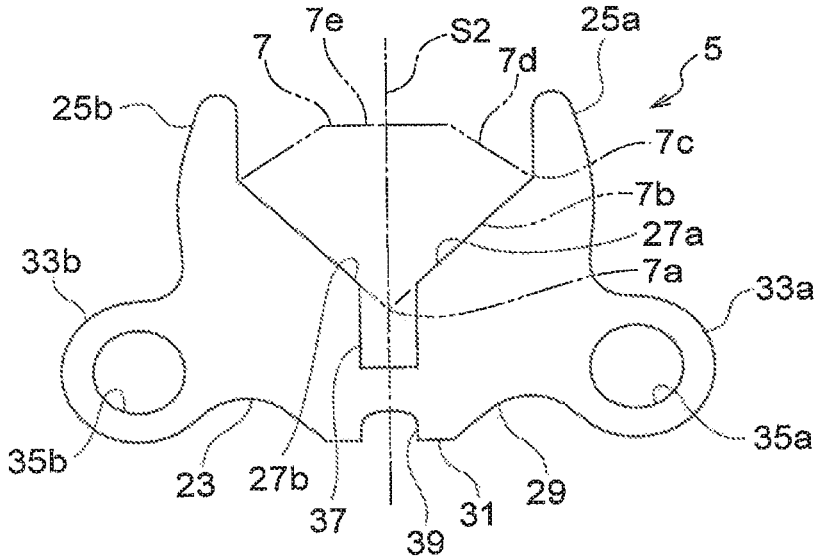
FIG. 2 is a side view illustrating the other plate member of the collet to which the present invention applied.

As shown in FIG. 1 to FIG. 5, a collet 1 according to the present embodiment is configured by assembling a first plate member 3 and a second plate member 5. Note that FIG. 1 and FIG. 2 are side views of the first plate member 3 and the second plate member 5 respectively and a diamond 7 is shown by a two-dot dashed line.

The diamond 7 here is, for example, a brilliant cut polyhedron which includes regions such as a culet 7*a*, a pavilion 7*b*, a girdle 7*c*, a crown 7*d* and a table 7*e* on a longitudinal cross section.

The first plate member 3 is formed by pressing a flattened plate member of a precious metal or the like, and the whole first plate member 3 has a uniform thickness. The first plate member 3 includes a support portion 9 having a region with which the pavilion 7*b* (back surface side) of the diamond 7 comes into contact and a pair of claw portions 11*a* and 11*b* that extend from both ends in a width direction of the support portion 9, and is formed symmetrically with respect to a central axis S1 (central axis of the diamond 7).

The support portion 9 is formed in a V-shape corresponding to a longitudinal cross-sectional shape of the diamond 7, and inclined surfaces 13*a* and 13*b* which are regions with which the pavilion 7*b* is in contact are formed on an inner surface of the V-shape. A relief portion 15 which is cut out into a rectangular cross-sectional shape is formed in the region where the inclined surfaces 13*a* and 13*b* of the support portion 9 cross each other to avoid contact with the culet 7*a* of diamond 7. Furthermore, an outer surface 17 of the support portion 9 opposite to the inclined surfaces 13*a* and 13*b* is formed into an arcuate cross-sectional shape. A flat surface 19 that extends in a direction substantially orthogonal to the central axis S1 is formed at a bottom of the outer surface 17 of the support portion 9.

A notched portion 21 which is notched into a rectangular cross-sectional shape from the flat surface 19 along the central axis S1 is formed in the outer surface 17 of the support portion 9. A width of the notched portion 21 in the direction orthogonal to the central axis S1 is set to be slightly larger than the thickness of the second plate member 5.

The claw portions 11*a* and 11*b* each include an arcuate outer surface continuous to the outer surface 17 of the support portion 9 and flat inner surfaces continuous to the inclined surfaces 13*a* and 13*b* respectively and extending along the central axis S1, and are set to a length that allows them to contact (lock) the crown 7*d* in the diamond 7 whose pavilion 7*b* is in contact with the inclined surfaces 13*a* and 13*b*.

Just like the first plate member 3, the second plate member 5 is formed by pressing a flattened plate member of a precious metal or the like and the whole second plate member 5 has a uniform thickness. The second plate member 5 includes a support portion 23 having a region with which the pavilion 7*b* of the diamond 7 comes into contact and a pair of claw portions 25*a* and 25*b* that extend from both ends of the support portion 23 in a width direction, and is formed symmetrically with respect to a central axis S2 (central axis of the diamond 7).

The support portion 23 is formed into a V-shape corresponding to the longitudinal cross-sectional shape of the diamond 7, and inclined surfaces 27*a* and 27*b* which are regions with which the pavilion 7*b* is in contact are formed on an inner surface of the V-shape. An outer surface 29 of the support portion 23 opposite to the inclined surfaces 27*a* and 27*b* is formed into an arcuate cross-sectional shape. A flat surface 31 extending in a direction substantially orthogonal to the central axis S2 is formed at a bottom of the outer surface 29 of the support portion 23. Connection portions 33*a* and 33*b* each extending in opposite directions with respect to the central axis S2 are formed on both sides of the support portion 23 in the width direction. The connection portions 33*a* and 33*b* each include hole 35*a*, 35*b* to which a connection member (which will be described later) such as a chain is locked.

A notched portion 37 which is cut out into a rectangular cross-sectional shape along the central axis 32 is formed in the region where the inclined surfaces 27*a* and 27*b* of the support portion 23 cross each other. A width of the notched portion 37 in the direction orthogonal to the central axis S2 is set to be slightly larger than the thickness of the first plate member 3. Note that in the present embodiment, a width of the notched portion 37 is set to be the same as the width of the notched portion 21 of the first plate member 3, but the widths of the notched portions 21 and 37 may be different depending on plate thicknesses of the first plate member 3 and the second plate member 5. A concave portion 39 which is cut out into an arcuate shape along the central axis S2 is formed in the flat surface 31.

The claw portions 25*a* and 25*b* each include an arcuate outer surface continuous to the outer surface 29 of the support portion 23 and a flat inner surface continuous to the inclined surfaces 27*a* and 27*b* respectively and extending along the central axis S2, and are set to lengths that allow them to contact (lock) the crown 7*d* of the diamond 7 whose pavilion 7*b* is in contact with the inclined surfaces 27*a* and 27*b*.

Figure 3:
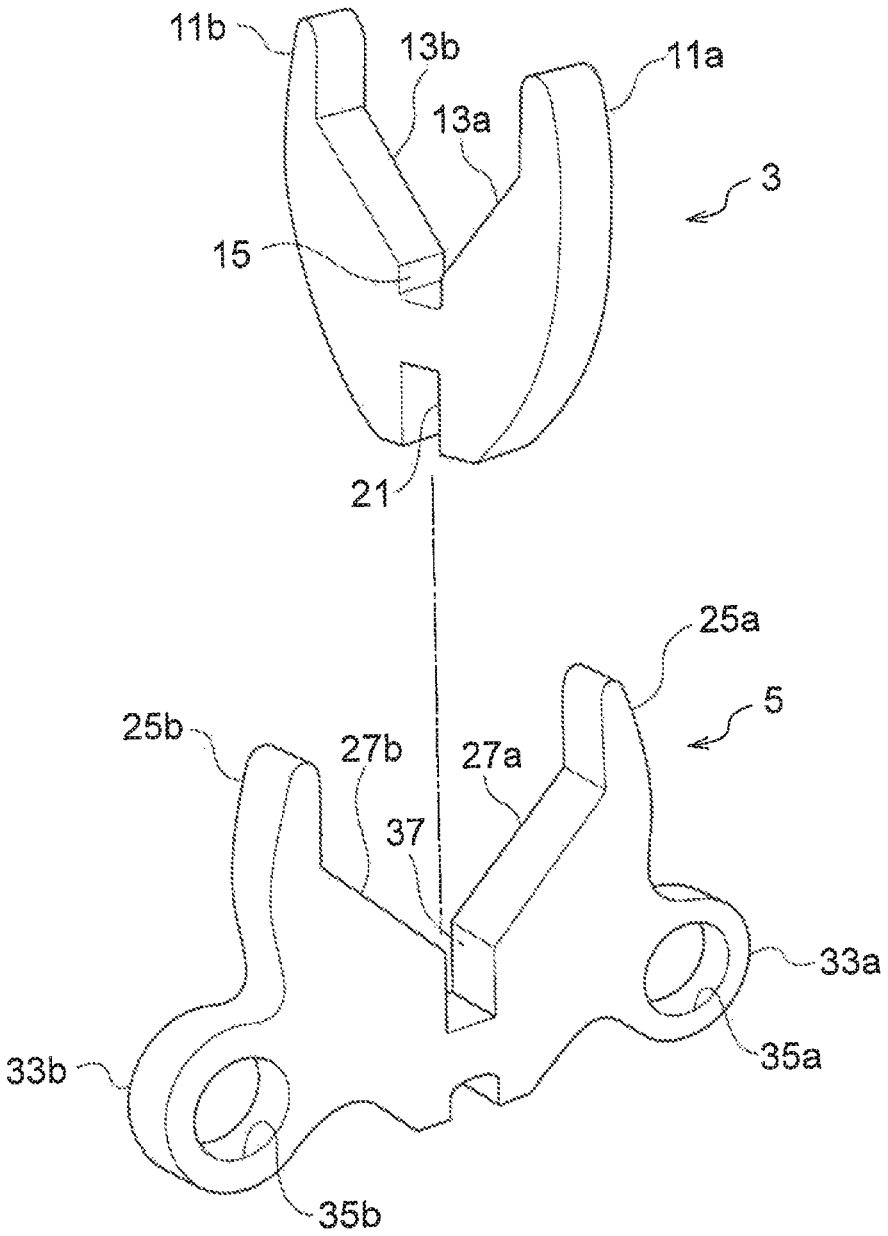
FIG. 3 is a perspective view illustrating a state during assembly of the two plate members.

In the collet 1, as shown in FIG. 3, the notched portion 21 of the first plate member 3 and the notched portion 37 of the second plate member 5 are caused to coaxially face each other and engage with each other to cross each other at substantially right angles, and the bottom surfaces of the notched portions 21 and 37 are caused to come into contact with each other, and the first plate member 3 and the second plate member 5 are thereby assembled together, both members being substantially orthogonal to (crossing) each other. That is, the notched portions 21 and 37 are formed in the first plate member 3 and the second plate member 5 at the respective bottoms by alternately cutting out the upper and lower parts of the respective bottoms along the central axes S1 and S2 of the respective support portions 9 and 23 so that the first plate member 3 and the second plate member 5 cross each other at right angles and engage with each other.

Figure 4:
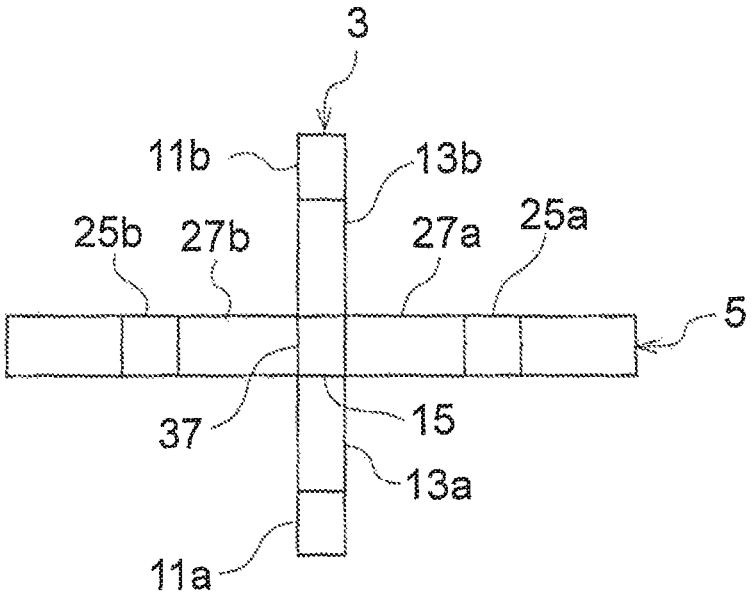
FIG. 4 is a top view of the collet to which the present invention is applied.
Figure 5:
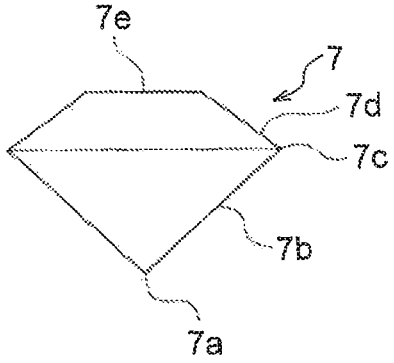
FIG. 5 is a perspective view illustrating a state during assembly of a jewel into the collet to which the present invention is applied.
Figure 5:
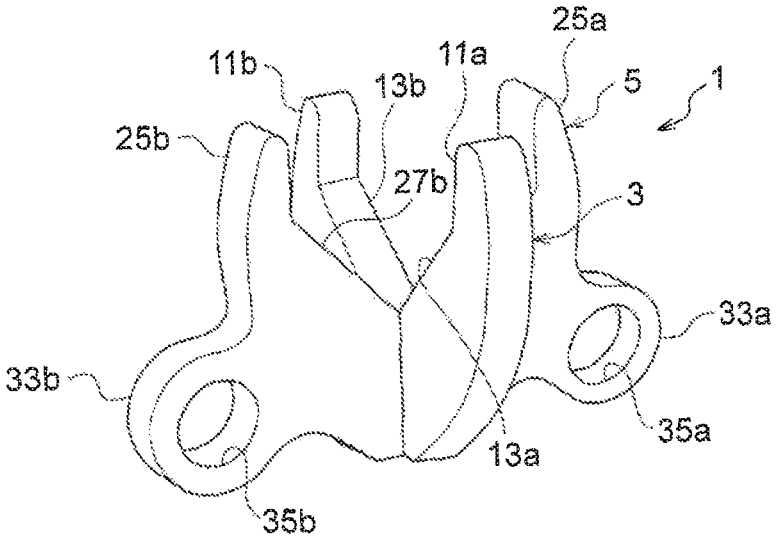

In the collet 1 assembled in this way, as shown in FIG. 4 and FIG. 5, the inclined surfaces 13*a* and 13*b* of the first plate member 3, and the inclined surfaces 27*a* and 27*b* of the second plate member 5 are arranged so as to be substantially orthogonal to each other, and the inclined surfaces 13*a* and 13*b* and the inclined surfaces 27*a* and 27*b* are located at a height that allows the inclined surfaces to come into contact with the pavilion 7*b* of the diamond 7 respectively. Furthermore, in the collet 1, the flat surface 19 the first plate member 3 and the flat surface 31 of the second plate member 5 are arranged on substantially the same plane.

In the collet 1, as shown in FIG. 5, the diamond 7 is inserted inside the claw portions 11*a*, 11*b*, 25*a* and 25*b*. With the culet 7*a* of the diamond 7 inserted in the relief portion 15 formed in the first plate member 3 of the collet 1, the pavilion 7*b* comes into contact with the inclined surfaces 13*a* and 13*b*, and the inclined surfaces 27*a* and 27*b* respectively.

Figure 6:
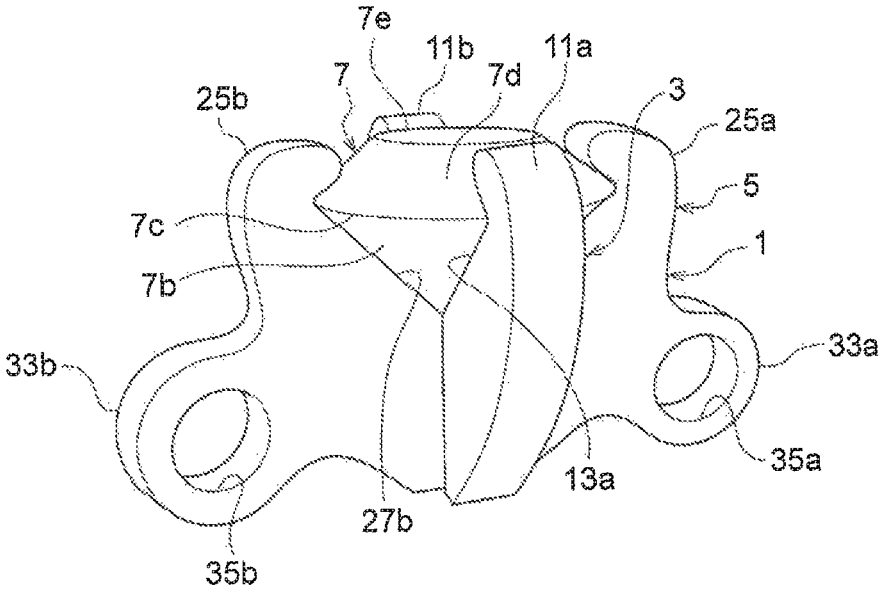
FIG. 6 is an external perspective view illustrating a state where an ornament is assembled into the collet to which the present invention is applied.
Figure 7:
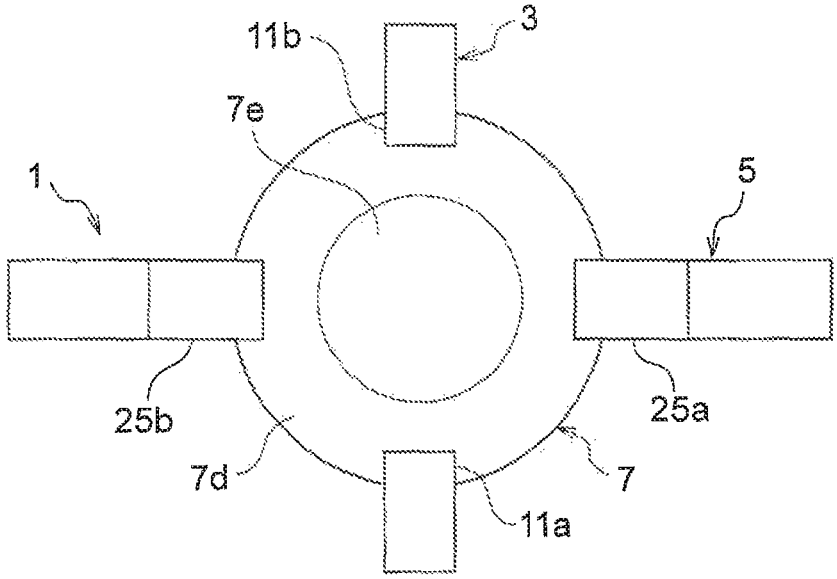
FIG. 7 is a top view of FIG. 6.

Next, the collet 1 as shown in FIG. 6 and FIG. 7, distal end portions of the claw portions 11*a* and 11*b*, and distal end portions of the claw portions 25*a* and 25*b* are inwardly bent respectively using a jig. As a result, with the pavilion 7*b* of the diamond 7 on the back surface side being in contact with the inclined surfaces 13*a* and 13*b*, and the inclined surfaces 27*a* and 27*b*, the crown 7*d* on the front surface side is locked to the claw portions 11*a* and 11*b*, and the claw portions 25*a* and 25*b*, and held to the collet 1.

According to the present embodiment, by causing the notched portions 21 and 37 to engage with each other so as to cross each other, the first plate member 3 and the second plate member 5 are assembled together three-dimensionally with the inclined surfaces 13*a* and 13*b* of the support portion 9, and the inclined surfaces 27*a* and 27*b* of the support portion 23 crossing each other, and the claw portions 11*a* and 11*b* and the claw portions 25*a* and 25*b* formed on the respective plate members 3 and 5 are arranged so as to surround the diamond 7. The two plate members 3 and 5 assembled in this way can hold the diamond 7 (stone setting) by causing the inclined surfaces 13*a* and 13*b* of the support portion 9 and the inclined surfaces 27*a* and 27*b* of the support portion 23 to contact the back surface side of the diamond 7 and locking the distal end portions of the claw portions 11*a* and 11*b* and the distal end portions of the claw portions 25*a* and 25*b* to the front surface side of the diamond 7.

Here, since the pair of claw portions 11*a* and 11*b* and the support portion 9, and the pair of claw portions 25*a* and 25*b* and the support portion 23 are formed of a single plate member, respectively, they can be integrally formed through press work, and moreover, even when the two plate members 3 and 5 are not mutually fixed by brazing or the like, the two plate members 3 and 5 restrict mutual movement by the respective claw portions 11*a*, 11*b*, 25*a* and 25*b* locking the diamond 7. Therefore, the collet 1 of the present embodiment can form jewelry through a simple operation of only assembling the two press-molded plate members 3 and 5, swaging the distal end portions of the respective claw portions 11*a*, 11*b*, 25*a* and 25*b* and locking them to the diamond 7, providing thus high productivity. Since the two plate members 3 and 5 can be press-molded regardless of their plate thicknesses, these thicknesses can be set to smaller values (freely) and the widths of the respective claw portions 11*a*, 11*b*, 25*a* and 25*b*, when the collet 1 is seen from outside, are all the same as the thicknesses of the plate members 3 and 5. Therefore, the smaller the widths (thicknesses) of the respective support portions 9 and 23 and the respective claw portions 11*a*, 11*b*, 25*a* and 25*b* become, the higher degree of exposure of the whole diamond 7 can be secured and the more brilliance of the diamond 7 can be extracted.

Moreover, in the present embodiment, since the support portions 9 and 23 of the two plate members and 5 are formed with the inclined surfaces 13*a*, 13*b*, 27*a* and 27*b* in shapes corresponding to the longitudinal cross-sectional shape of the diamond 7, when the diamond 7 is held to the collet 1, the pavilion 7*b* is disposed along the support portions 9 and 23. In this way, it is possible to reduce the sizes of gaps between the diamond 7 and the support portions 9 and 23, and thereby reduce backlash of the diamond 7 and strengthen the holding force of the diamond 7. Note that in the present embodiment, both the support portions 9 and 23 contact the back surface side (pavilion 7*b*) of the diamond respectively and thereby strengthen the holding force of the diamond out one of the support portions may also be configured to contact the back surface side of the diamond 7.

Figure 8:
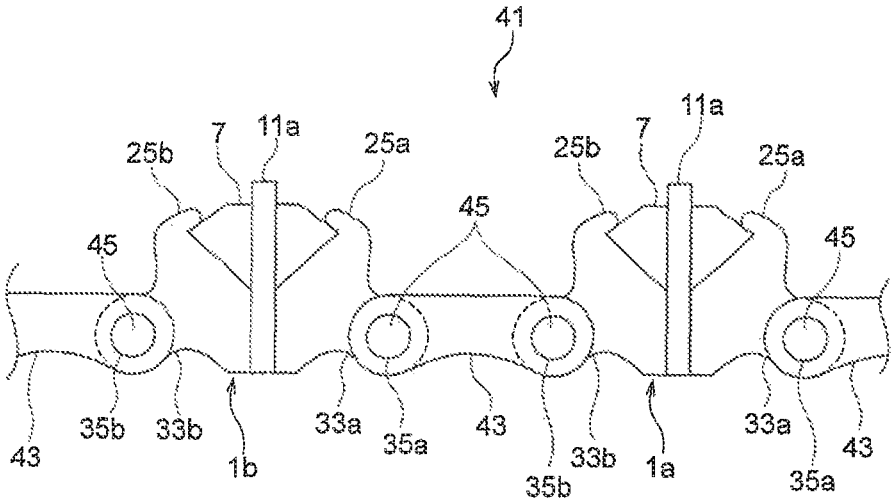
FIG. 8 is a side view illustrating an example of jewelry to which the present invention is applied.

Next, an example of jewelry using the collet 1 of the present embodiment will be described. FIG. 8 is a side view illustrating part of a bracelet using the collet 1 in plurality. Note that examples of jewelry to which the collet 1 of the present embodiment is applied are not limited to a bracelet but include a necklace, pendant, ring and ear ring, and so on.

With a bracelet 41 of the present embodiment, between the neighboring collets 1*a* and 1*b*, the connection portion 33*b* of the collet 1*a* and the connection portion 33*a* of the collet 1*b* are connected together via a connection member 43. As the connection member 43, a known member such as a chain can be used. The connection member 43 according to the present embodiment is constructed of a bent precious metal plate member which includes through holes to pivotally support columnar shaft members 45 at both ends thereof. Both ends of the shaft member 45 inserted through a hole 35*b* formed in the connection portion 33*b* of the collet 1*a* are pivotally supported by the connection member 43 and both ends of the shaft member 45 inserted through a hole 35*a* formed in the connection portion 33*a* of the collet 1*b* are pivotally supported by the connection member 43, and the neighboring collets 1*a* and 1*b* are thereby connected together so as to be rotatable around the shaft member 45. Note that the shaft member 45 can also be formed integrally with the connection member 43 like a boss.

In the present embodiment, since the holes 35*a* and 35*b* are formed in one (here, the second plate member 5) of the two plate members 3 and 5 making up the collet 1, it is possible to directly connect the connection member 43 to the collet 1, making simpler the structure of the bracelet 41. Furthermore, when the two plate members 3 and 5 are assembled, it is possible to distinguish between the two plate members 3 and 5 according to the presence or absence of the hole 35*a* or 35*b*, thereby prevent mistaking of order in which the plate members 3 and 5 are superimposed one on another and assembling workability of the collet 1 improves.

Since the productivity of the collet 1 of the present embodiment can be improved, the bracelet 41 provided with the collet 1 can thereby reduce manufacturing cost of the whole bracelet 41. Moreover, since the degree of exposure of each diamond 7 held to the collet 1 increases, the beauty of the whole bracelet 41 improves.

The embodiment of the present invention has been described in detail with reference to the accompanying drawings so far, but the present embodiment is no more than an illustration of the present invention, and can be changed or modified without departing from the scope of the present invention. For example, when the embodiment of the present invention is applied to a pendant, ring, ear ring or the like, the connection portions 33*a* and 33*b* and the holes 35*a* and 35*b* provided on the support portion 23 of the second plate member 5 need only to be provided on any one side or need not be provided at all. Furthermore, those shapes may be changed as appropriate depending on the type of jewelry to which the collet 1 according to the embodiment of the present invention is applied.

Although the first plate member 3 and the second plate member 5 of the present embodiment are formed symmetrically to correspond to the shape of the ornament (diamond 7) respectively, if, for example, the ornament is a dissimilar member with an asymmetric shape, the first plate member 3 and the second plate member 5 may be asymmetric to correspond to the shape of the ornament.

Furthermore, although the first plate member 3 and the second plate member 5 of the present embodiment are formed of plate members of precious metal or the like, their materials are not limited to a precious metal or the like if they are materials that can be press-molded, and they can be configured by press-molding an icon-based metal plate member and applying desired plating thereto.

DESCRIPTION OF SYMBOLS

1 Collet
3 First plate member
5 Second plate member
7 Diamond (ornament)
9, 23 Support portion
11*a*, 11*B*, 25*a*, 25*b* Claw portion
13*a*, 13*b*, 27*a*, 27*b* Inclined surface
15 Relief portion
21, 37 Notched portion
33*a*, 33*b* Connection portion
35*a*, 35*b* Hole
43 Connection member
45 Shaft member

What is claimed is:

1. A collet comprising:

two plate members that have a uniform thickness and being adapted to hold a brilliant cut ornament, wherein:

each of the plate members that is formed by press processing comprises:

a support portion that includes a base portion and a fork portion, the fork portion having an inclined surface adapted to correspond to a shape of a pavilion at a back surface side of the ornament; and a pair of claw portions that extend from respective distal ends of the fork portion and are adapted to be locked to a periphery of a crown at a front surface side of the ornament;

the pair of claw portions are provided so that a pair of facing surfaces adapted to be at a distal end side from a girdle with a maximum diameter of the ornament are parallel to a central axis of the support portion, and a claw thickness defined by the facing surface and a back surface thereof gradually becomes smaller toward a distal end of the claw portions;

one of the two plate members has a notched portion that is notched from a lower surface of the base portion thereof while the other has a notched portion that is notched from an upper surface of the base portion thereof along the central axes of the respective support portions, and the two base portions cross at right angles to engage and assemble the notched portions with each other; and the notched portions have a width that is set to correspond to a thickness of the plate members and have a depth that is set so that the support portions have the same height.

2. The collet according to claim 1, wherein the one of the plate members has a recess that is formed in an upper part of the base portion so as to be adapted to avoid contact with a culet of the ornament in a region where the inclined surfaces of the fork portion cross each other.

3. Jewelry comprising the ornament held by the collet according to claim 2, wherein the ornament is held by swaging the distal ends of the claw portions so that at least an upper part of the pavilion is brought into contact with the inclined surfaces of the two plate members and of the culet located in the recess.

4. The collet according to claim 1, wherein at least one hole for connection with a connection member is formed in the base portion of either one of the plate members.

* * * * *